United States Patent [19]

Lemperiere

[11] Patent Number: 5,032,038

[45] Date of Patent: Jul. 16, 1991

[54] OVERFLOW SPILLWAY FOR DAMS, WEIRS AND SIMILAR STRUCTURES

[75] Inventor: François Lemperiere, Meudon, France

[73] Assignee: GTM Batiment et Travaux Publics, Cedex, France

[21] Appl. No.: 628,574

[22] Filed: Dec. 14, 1990

[30] Foreign Application Priority Data

Dec. 21, 1989 [FR] France ..... 89 16960

[51] Int. Cl.[5] ..... E02B 7/22; E02B 8/06

[52] U.S. Cl. ..... 405/108; 405/90; 405/111; 405/114

[58] Field of Search ..... 405/80, 87, 90, 94, 405/107, 108, 110, 111, 114

[56] References Cited

U.S. PATENT DOCUMENTS

| | | | |
|---|---|---|---|
| 565,019 | 8/1896 | Newburg | 405/115 X |
| 972,059 | 10/1910 | Clarke | 405/114 |
| 2,118,535 | 5/1938 | Betts | 405/94 |
| 2,961,731 | 11/1960 | Buzzell et al. | 405/114 X |
| 3,342,033 | 9/1967 | Crouch et al. | 405/114 |
| 4,650,368 | 3/1987 | Bayer | 405/111 |
| 4,661,014 | 4/1987 | Aubert | 405/111 |

FOREIGN PATENT DOCUMENTS

| | | | |
|---|---|---|---|
| 2212313 | 11/1978 | Fed. Rep. of Germany | 405/91 |

*Primary Examiner*—David H. Corbin

*Attorney, Agent, or Firm*—Amster, Rothstein & Ebenstein

[57] ABSTRACT

For the purpose of effecting a quasi-permanent raising of the normal water level of an impounded reservoir and thereby augmenting its storage capacity except during the passage of major floods, the invention consists of installing on the sill of the spillway a water level raising means comprising at least one heavy element, the said means or water level raising elements being capable of resisting the water loads when spilling moderate heads (for discharging the floods of shorter recurrence intervals) by virtue of their own weight but breaching by overturning at a predetermined head corresponding to a level not higher than a predetermined maximum water level in order to discharge larger floods.

16 Claims, 9 Drawing Sheets

RM
RN'
RN
N
10
11
12
6
15
21
21a
21'
21''
22
23
24
25
26
27

OVERFLOW SPILLWAY FOR DAMS, WEIRS AND SIMILAR STRUCTURES

TECHNICAL FIELD

This invention concerns an overflow spillway for dams and similar structures comprising an overspill sill whose crest is set at a first predetermined level, lower than a second predetermined level corresponding to the maximum reservoir level for which the dam is designed, the difference between the said first and second predetermined levels corresponding to a predetermined maximum discharge of a design flood and a moveable water level raising means on the sill.

BACKGROUND OF THE INVENTION

Current practice for the design and construction of overspill dams is such that they are designed for flood conditions (e.g. 1000-year flood) producing very high heads on the sill when spilling (depth of water on the sill of the order of 1 m to 5 m).

For a given flood discharge capacity, an uncontrolled overflow spillway offers greater safety against hydrological uncertainty (one of the most important risks for a dam) than gated discharge works.

Against this advantage, a completely uncontrolled overspill is wasteful of live reservoir capacity, by an amount commensurate with the maximum head of water on the sill, i.e. the difference in elevation between the abovementioned two predetermined levels. The capacity thus lost may represent a significant percentage (as much as or even more than 50%) of total live reservoir capacity, especially for dams of small to moderate size.

The problem which the invention is intended to solve can be summarised in the following two principle goals which may be obtained singly or in combination:

1) To augment the storage capacity of a dam with an uncontrolled overflow spillway, on a near-permanent basis.
2) To retain and/or increase the safety and reliability of operation that is an inherent feature of uncontrolled overflow spillways by permitting the unobstructed passage of major floods while tolerating overspilling by small or moderate floods without outside action or any significant modification to the existing structure.

Various means for augmenting reservoir capacity have been proposed and currently exist. Most consist basically of some system of gates which prevent flow over the sill when closed. Automatically or manually operated, conventional or inflatable gates of all kinds generally exhibit high capital cost and demand routine maintenance and periodic testing. They also demand continuous human supervision or an often costly and sophisticated automatic system controlled by the water level in the reservoir which is never totally free from the risk of breakdown or malfunction. Lastly, for a given discharge capacity, the safety and reliability of operation of gated discharge works are less than for an uncontrolled (ungated) overflow spillway.

There are means of temporarily augmenting reservoir storage capacity such as sandbags or flashboards but they are of limited utility and since they demand human action prior to the arrival of every river flood, they involve a major risk.

Some large embankment dams are provided with 'fuse plug' sections topped out at a lower crest elevation than the main dam which operate by erosion of the constituent materials when a very large flood causes a large rise in headwater level. The fuse plug is designed to prevent uncontrolled catastrophic overspilling of a major flood over the main dam by concentrating its effects on a specially prepared section designed to be washed away by erosion to provide extra discharge capacity. Once the fuse plug has been destroyed, major repair works are necessary before the dam can be restored to normal service.

To the applicant's knowledge, there would thus appear to be no means currently in existence of satisfactorily fulfilling the goals stated hereinabove, of simple operation and moderate cost.

SUMMARY OF THE INVENTION

With the invention, the abovementioned problem is solved by the fact that the water level raising means comprises at least one rigid heavy element resting on the crest of the spillway sill and held in place thereon by gravity, the said element having a predetermined height which is less than the difference between the first and second predetermined levels and which corresponds, for a headwater level substantially equal to the said second or maximum level, to a mean flood with a smaller predetermined discharge than the predetermined maximum discharge, the said element being of such size and weight that the moment of the forces applied by the headwater on the element comes to equal the moment of the gravity forces tending to maintain the element in place on the sill so that consequently the element is destabilized when the headwater reaches a third predetermined level higher than the top of the element but not higher than the second predetermined level.

Under these circumstances, it is clear that the storage capacity of the dam is augmented by an amount commensurate with the height of the water level raising element. The element(s) can be fabricated at a more moderate cost than gates and if they are installed on the sill of an existing dam, there is no need for any major modifications thereto as will be described below. It is also clear that, during floods of moderate size, so long as the headwater does not reach the said third predetermined level which in practical terms can be set equal to or slightly lower than the said second predetermined level (i.e. maximum level or maximum reservoir level), water can spill over the element(s) to discharge the flood without destroying the element(s) and thereby, without any reduction in the augmented storage capacity of the dam. During a major flood the headwater reaches the said third predetermined level and the element(s) are destabilized and expelled by the water solely by the action of the water loads with no external contribution, thus restoring to the spillway its full discharge capacity as determined by the head on the sill for which the dam was designed.

Although theoretically not essential, an abutment of predetermined height is preferably provided on the overspill sill at the toe and on the downstream side of the water level raising element to prevent its sliding downstreamwards on the sill without preventing it from overturning over the abutment when the headwater reaches the said third predetermined level. The height of the abutment is of course given consideration as will be described below in determining the size and weight of the element(s).

A seal may be provided between the sill and the base portion of the element near the upstream edge of the said base portion. Nevertheless such a seal is not absolutely essential if leakage between the element and sill is slight and the area of the sill on which the said element(s) sit is properly drained so that no appreciable uplift pressure can establish under the said element(s) if no seal is provided. As will be described below, means can be provided for automatically establishing an uplift pressure under the said element(s) when the headwater reaches the said third predetermined level in order to assist in destabilizing and overturning the said element(s) when necessary for discharging a major flood.

The invention is applicable to the sills of existing dam spillways as well as those under construction. In the first case, the crest of the existing sill is preferably cut back lower than the said first predetermined level and the water level raising element(s) is/are placed on the lowered sill. In this case, the storage capacity of the dam can be maintained at the same value as before the lowering of the sill or it can be augmented, depending on whether the height of the element(s) is such that their tops are level with or higher than the said first predetermined level but lower than the said third predetermined level. Regardless of the height of the element(s) within the limits described, safety is greater than with the unlowered spillway sill since the free passage obtained after the overturning of the element(s) is deeper when the sill has been lowered so that the spillway can discharge a larger flood than the original design flood.

In designing a new dam, the difference between the first and second predetermined levels can be increased (which increases safety) without reducing storage capacity since capacity can be maintained or augmented without reducing safety by providing one or more water level raising elements all as described herein.

If more than one element are to be provided, an element or group of elements can be designed to overturn at a lower predetermined headwater level than another element or group of elements which themselves can be designed to overturn at a lower headwater level than a third element or group of elements, and so on. In this way, it is possible, if desired, to increase discharge capacity progressively to suit the size of the river flood.

If one or more elements have been overturned and expelled by a major flood, they can be conveniently and cheaply replaced with new elements without the need for any major repairs after the flood has receded.

Other features, benefits and advantages will appear in the course of the ensuing description of various embodiments of the invention, given as an illustration only, with reference to the appended drawings in which:

DETAILED DESCRIPTION

Figure 1:
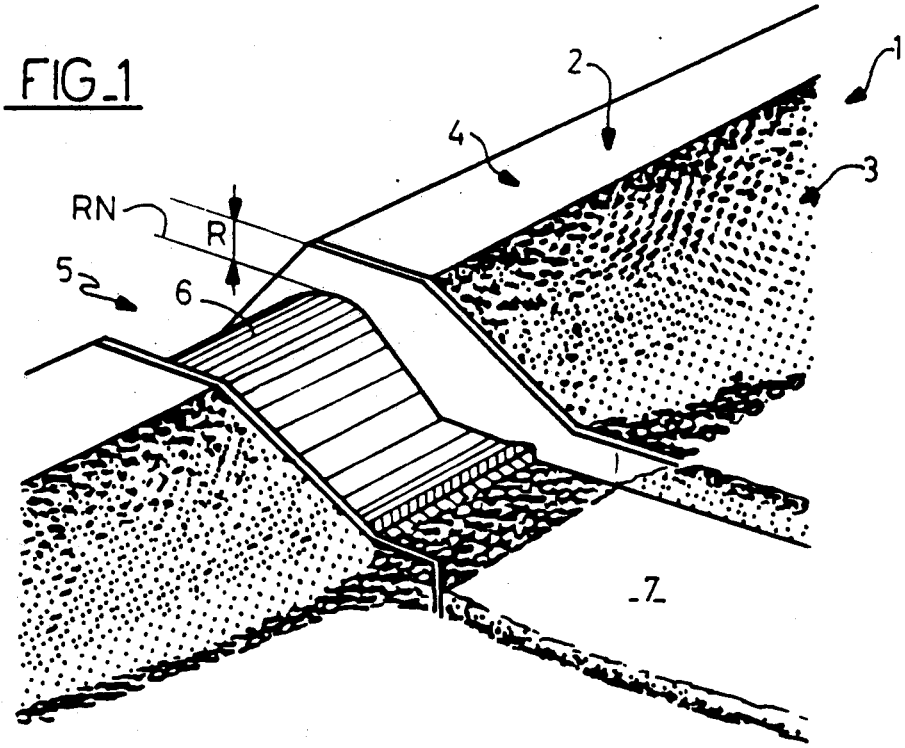
FIG. 1 is a perspective view of a structure such as a dam with an uncontrolled overflow spillway to which the invention can be applied.

The structure 1 shown in FIG. 1 may be an earth or rock dam or a concrete or masonry dam. It is stressed that the invention is not confined to the type of dam shown in FIG. 1 but on the contrary is applicable to any type of known dam with an uncontrolled spillway.

In FIG. 1, reference numeral 2 designates the dam crest, 3 is the downstream dam face, 4 is the upstream dam face, 5 is the spillway, 6 is the sill of spillway 5 and 7 is a discharge channel. The spillway 5 may be located in the central section of dam 1 or at one extremity thereof or excavated in the river bank without affecting the applicability of the invention.

Figure 2A:
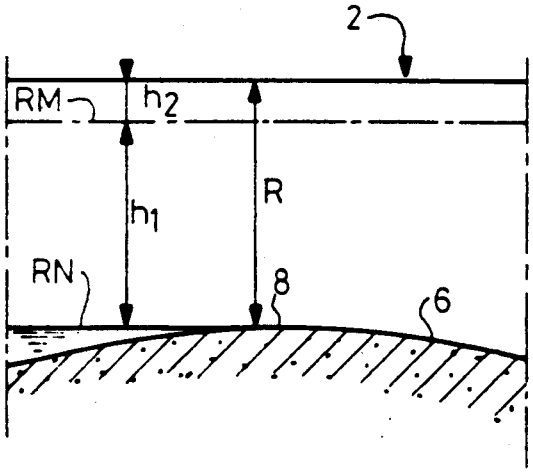
FIGS. 2*a* and 2*b* are vertical sections at larger scale of the crest of the uncontrolled spillway sill of the dam shown in FIG. 1 for two different headwater levels.
Figure 2B:
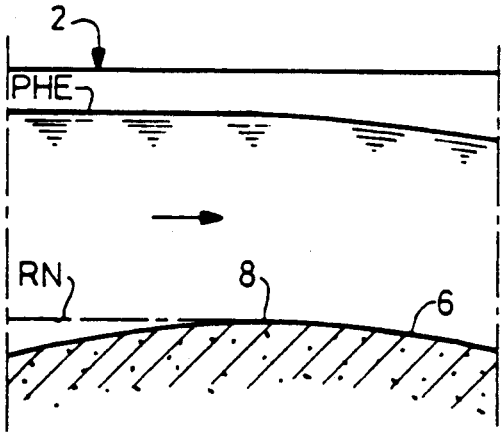

At a dam with an uncontrolled overflow spillway, the level RN called the full supply level when the dam is operating (see also FIG. 2*a*) is determined by the crest 8 of sill 6. The elevation of level RN determines the maximum reservoir storage capacity which is the maximum volume of water that can be impounded by the dam. The vertical distance R, called the freeboard, between the spillway crest 8 and the crest 2 of the dam is the sum of two terms, viz. a rise $h_1$ in the headwater level due to the arrival of a river flood up to the highest flood level RM or maximum water level PHE when the spillway is discharging the maximum flow for which it is designed (FIG. 2*b*), and an additional height $h_2$ protecting the dam crest 2 against oscillations of the water surface at RM (waves, seiches, etc.).

In a conventional dam with uncontrolled overflow spillway like the structure shown in FIG. 1, the volume of water between full supply level RN and maximum water level RM is not stored and is therefore wasted. One of the purposes of the invention is to heighten on a near-permanent basis the full supply level of the reservoir and thereby augment the reservoir storage capacity except when major floods have to be discharged.

Figure 3:
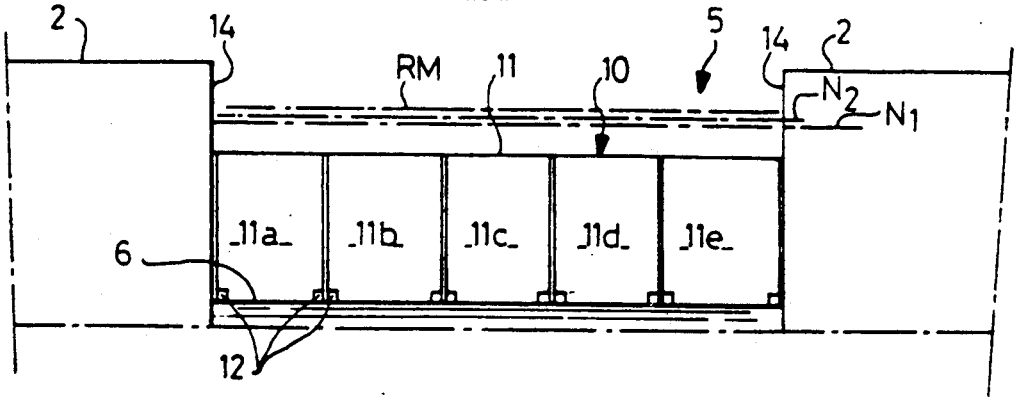
FIG. 3 is a view in elevation of the spillway shown in FIG. 1 seen from the downstream side and provided with a water level raising means of the invention.
Figure 4:
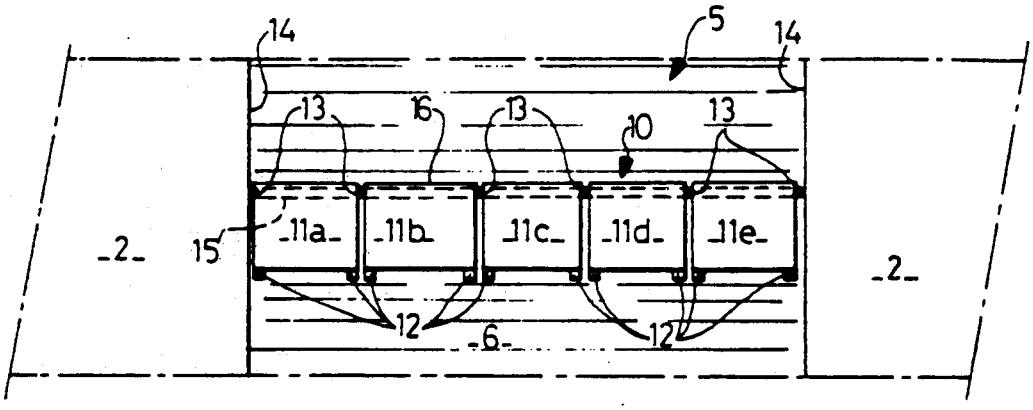
FIG. 4 is a plan view of the spillway shown in FIG. 3.

For this purpose, the invention involves placing on the overspill sill 6 a water level raising means 10 comprising at least one element 11, for example five elements 11*a*–11*e* as illustrated in FIGS. 3 and 4. The water level raising means 10 or elements 11 thereof are capable of resisting without rupture the head of water caused by moderate spilling (to discharge the more frequent floods) by gravity action but breaching by overturning under a predetermined head corresponding to a level N not higher than the maximum level RM and allowing the largest floods to discharge.

The number of elements 11 in the water level raising means is not limited to five as shown in FIGS. 3 and 4 but may be more or less to suit the length (reckoned lengthwise along the dam) of the spillway 5. The number of elements is preferably chosen such as to have small unit weights for ease of installation and replacement of the said elements.

Each water level raising element 11 is set on the spillway sill 6 and held in place by gravity. Each element is preferably restrained from sliding downstreamwards by an abutment 12 at the downstream toe of the element 11. The abutment 12 may for example be let into the sill 6 as shown by way of example in FIG. 5*a* and it may be discontinuous as illustrated in FIGS. 3 and 4. Nevertheless, the abutment 12 may if desired be continuous. As will be described hereinunder, the height of the abutment 12 is predetermined but may be variable according to the loads involved and the headwater level at which it is desired that each element 11 commences to overturn.

As illustrated in FIG. 4, a conventional seal 13 made of rubber for example is provided at each end of the water level raising means 10 between the said means and the training walls 14 of the spillway 5. When the water level raising means 10 is made up of more than one element 11, seals 13 are also provided between the vertical side faces of adjacent elements 11 as illustrated in FIG. 4. Another seal 15 is also preferably provided between the spillway sill 6 and the undersides of water level raising elements 11 near the upstream edge 16 of the said undersides as illustrated by way of example in FIGS. 4 and 5*a*. Although FIG. 5*c* shows the seal 15 fixed to water level raising element 11, the said seal could equally be fitted in a groove in sill 6. As illustrated in FIG. 4, seals 13 and seal 15 (when the latter is provided) are set in the same vertical plane. A drainage system in addition to or in place of the seal 15 can be incorporated in a known fashion in the spillway sill 6 where it underlies the water level raising means 10 in order to keep this area dry and prevent uplift pressures acting on the element(s) 11 under normal conditions.

Figure 5A:
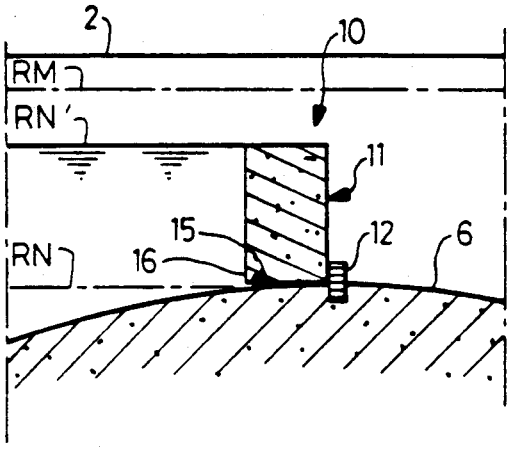
FIGS. 5*a* to 5*e* are vertical sections illustrating the manner in which the water level raising means of the invention functions before, during and after the discharging of a river flood.
Figure 5B:
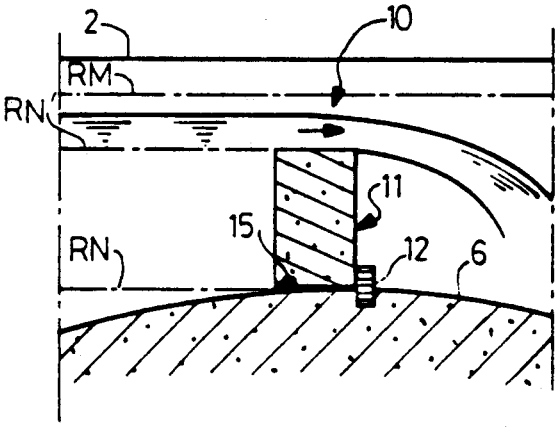
Figure 5C:
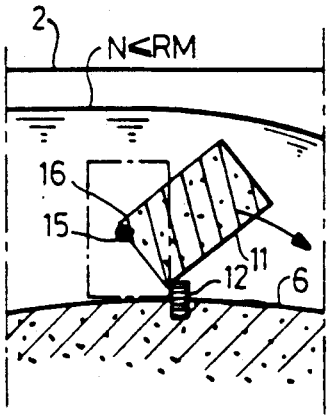

As illustrated in FIG. 5*a*, the water level raising means 10 of the invention raises the full supply level in the reservoir from level RN, which is the elevation of the spillway sill crest in the absence of water level raising means 10 to a level RN′ corresponding to the height of the water level raising means 10 above the sill 6. As will be explained below, each water level raising element 11 is designed to be self-stable under water loads not in excess of the head applied by a predetermined water level N which is not higher than the maximum water level RM aforementioned. If for example the said predetermined level N is equal to RM then, so long as the water level remains below RM during floods of small to moderate size and between RN′ and RM, the excess water spills over the water level raising means 10 as shown in FIG. 5*b* without the said means being washed away. After the flood has receded, the headwater level falls back to RN′ or a lower level if water is otherwise drawn from the reservoir.

Figure 5D:
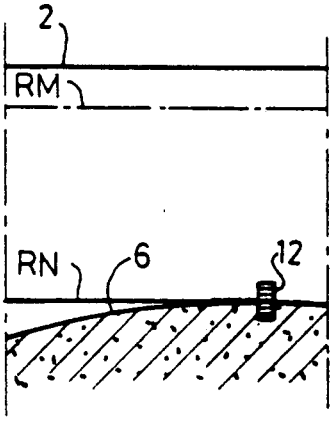
Figure 5E:
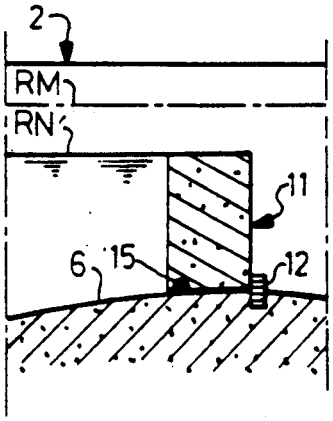

However if under the circumstances described the headwater level reaches a predetermined level N equal to or slightly lower than RM in the event of the arrival of a major or extraordinary flood, at least one of the elements 11 forming the water level raising means 10 is destabilized by water pressure and rotates around the abutment 12 as shown in FIG. 5*c* and the element(s) 11 which have overturned in this way are expelled and carried by the floodwater at least as far as the foot of the spillway 5, thereby enabling the largest floods to discharge. After recession of a major flood which has overturned the water level raising means 10, conditions at the overspill sill 6 are as shown in FIG. 5*d*, where the headwater level has returned to RN or lower. It is possible to carry a small number of spare elements 11 always available on site to make good the water level raising means 10 as necessary and so restore the higher full supply level RN′ as shown in FIG. 5*e*. It is stressed that failure to replace any element(s) after a major flood has overturned at least one element 11 in no way affects the operational safety of the structure.

Risks of jamming or other type of failure of the system to operate by reason of floating debris can easily be overcome by using conventional techniques of upstream protection adapted to suit the individual case. Such protection may for example consist of floating booms across the reservoir some distance upstream of the spillway or barriers on the upstream face of the dam.

There now follows a quantified example of the design of a water level raising means of the invention. In normal practice, the dimensions of dams and overflow spillways are set such that the level of the headwater (reservoir level) reaches the maximum water level RM during the passage of a predetermined flood called the design flood. This may for example be the flood occurring only one year in a thousand years (1000-year flood).

Let it be assumed that the river flow during the design flood is for example 200 $m^3/s$ and that the uncontrolled overflow sill 6 is 40 m long. Then, the height H of the head of water on the sill 6 (the depth or thickness of the overflowing nappe) needed to discharge the design flood flow must be such as to discharge 5 $m^3/s$ per linear meter of sill. This height H can be calculated with the equation $$Q = 1.8\ H^{3/2} \qquad (1)$$

from which it can be seen that H is approximately equal to 2 m under the abovementioned assumptions. Again, on these assumptions, if there is no system of gates or other means of preventing flow over the sill, the elevation of the sill 6 of spillway 5 must be set 2 m lower than the maximum water level RM in order to discharge the 1000-year flood and the volume of water corresponding to this height of 2 m is lost for productive use.

In designing the proper height of the water level raising elements 11, the invention is based on the fact that the maximum river discharge observed on average over a 20-year period is much less than the design flood flow. In the illustrative example given here, it might be about 50 $m^3/s$. From equation (1) this flow can be discharged with a head on the sill of approximately 0.8 m. If it is accepted that the water level raising elements 11 might be destroyed on average once every twenty years, the said elements can be made 1.2 m high (2 m−0.80 m=1.2 m) to permit the 50 $m^3/s$ discharge to overflow over the elements 11 with a depth of water on them of 0.8 m. Under these circumstances, the full supply level RN' is raised 1.20 m higher than the full supply level RN for the uncontrolled overflow spillway sill 6 in the absence of the water level raising means. If the water level raising elements are made more than 1.2 m high, the depth of the overflowing water will be less than 0.8 m and it would have to be accepted that the said elements might be destroyed for example every ten years but the full supply level on the other hand would be raised even higher. Conversely, if the water level raising elements are made less than 1.2 m high, the depth of overflowing water would be more than 0.8 m and the said elements would then only be destroyed once in every 50 or 100 years but the full supply level would then be lower than in the previous cases. The choice of water level raising element height is thus chiefly based on economics. It is probably preferable to set a twenty year interval between any two successive total destructions of the water level raising means which would mean a theoretical height of 1.2 m for the elements in the example considered.

There are advantages if not all the water level raising elements 11 overturn for the same headwater level. For example, a single element such as element 11*c* in FIGS. 3 and 4 can be arranged to overturn when the water reaches a first level N1 approximately 10 cm lower than maximum water level RM, at least one other element 11 such as elements 11*b* and 11*d* can be arranged to overturn when the water reaches a second level N2 approximately 5 cm lower than maximum water level RM and the other elements 11 such as 11*a* and 11*e* can be arranged to overturn when the water reaches the said maximum water level RM.

In this manner, the destruction of the first element 11*c* by a flood of moderate size might be sufficient to discharge the flood without any further rise in headwater level, which would prevent destruction of elements 11*a*, 11*b*, 11*d* and 11*e* . However, the 10 cm margin thus allowed adds to the depth of the nappe overflowing the elements so that the height of the elements and thereby of the extra water stored (RN'−RN) becomes 1.1 m (2 m−0.8 m−0.1 m) in the example considered.

The overturning of water level raising element(s) 11 and their ensuing expulsion is governed by (i) the driving moment Mm, being the moment of the forces tending to overturn the relevant element and (ii) the resisting moment Mr, being the moment of the forces tending to maintain the element stable. If no triggering device directly controlled by water level is provided to trigger the overturning of the element at precisely the predetermined water level, the water level at which the opposing forces are balanced can only be determined to within some degree of uncertainty which may be as much as 0.2 m. Under these circumstances, it may be necessary for safety reasons to reduce the height of the element(s) 11 by an amount commensurate with this margin of uncertainty, say by 0.2 m for example. Nevertheless it is possible to dispense with this need to reduce the height of the elements by providing a triggering device which will be described below with reference to FIG. 9.

For the 50 $m^3/s$ flow considered in this example, it is possible to reduce the 0.8 m depth of overflowing water, being the maximum head on the water level raising means before the element(s) overturn, by changing the crest of the elements 11 considered singly or in combination from rectilinear and parallel to the crest of the spillway sill 6 to a non-rectilinear shape, e.g. a dog-leg, zig-zag or curved line, in order to increase the length available for the abovementioned flow to discharge. If the length is doubled in this way, the 50 $m^3/s$ flow will be spread over a length of 80 m instead of 40 m and the maximum head on the crest of the water level raising means is reduced from 0.8 m to 0.5 m. If all other conditions remain unchanged, this enables the water level raising elements 11 to be made 0.3 m higher and thereby increase the volume of water stored in the reservoir accordingly. Various forms of elements for increasing the overflow length will be described below with reference to FIGS. 11*e* to 11*g*.

Figure 6:
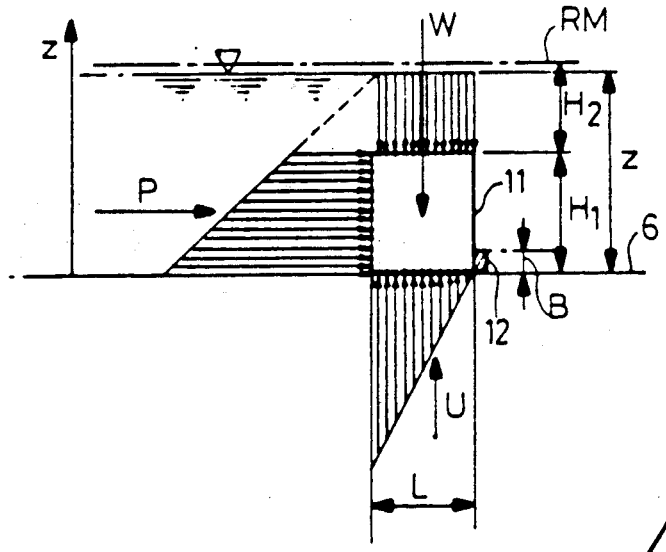
FIG. 6 is a graphical representation of the forces acting on a water level raising element of the invention in service.

FIG. 6 shows the forces which may be applied to a water level raising element 11 of the invention in service. In the description which follows, it is assumed that the element 11 is parallelepipedic in shape with a width (i.e. the dimension in the upstream-downstream direction) L and a height $H_1$. In FIG. 6, RM designates as before the maximum reservoir level, B denotes the height of the abutment 12 above the sill 6, $H_2$ designates the maximum head on crest of element 11 (the maximum depth of overflowing water before the element overturns) and z designates the water level above the sill 6. The driving forces tending to overturn the element 11 are the pressure P of the water acting on the upstream face of element 11 and the uplift pressure U which under some conditions acts on the underside of the said element 11 if water leaks through the seals or if the triggering device to be described below functions. The resisting forces tending to maintain the element 11 stable are the sum W of the weight of the element 11 and the weight of water which is the some conditions present on top of element 11.

In calculating the values of P, U and W and the values of the corresponding driving and resisting moments with respect to abutment 12, it is necessary to consider several conditions arising from the depth of water z above sill 6. The values of P, U and W and of the corresponding driving and resisting moments for these different conditions are summarised hereunder, the values being expressed per unit length of element 11.

a) if: $0<z<3$ B:

$$P=\tfrac{1}{2}\cdot\gamma_\omega\cdot z^2 \quad (2)$$

$$U=\tfrac{1}{2}\cdot\gamma_\omega\cdot z\cdot L \quad (3)$$

$$W=\gamma_b\cdot H_1\cdot L \quad (4)$$

$$Mm=0 \quad (5)$$

$$MmU=\tfrac{1}{3}\cdot\gamma_\omega\cdot z\cdot L^2 \quad (6)$$

$$Mr = \frac{1}{2} \cdot \gamma\omega \cdot H_1 \cdot L^2 + \frac{1}{2} \cdot \gamma\omega \cdot z^2 \cdot \left(B - \frac{z}{3}\right) \quad (7)$$

b) if: 3 $B<z<H_1$:

$$P=\tfrac{1}{2}\cdot\gamma_\omega\cdot z^2 \quad (8)$$

$$U=\tfrac{1}{2}\cdot\gamma_\omega\cdot z\cdot L \quad (9)$$

$$W=\gamma_b\cdot H_1\cdot L \quad (10)$$

$$Mm = \frac{1}{2} \cdot \gamma\omega \cdot z^2 \cdot \left(\frac{z}{3} - B\right) \quad (11)$$

$$MmU=Mm+\tfrac{1}{3}\cdot\gamma_\omega\cdot z\cdot L^2 \quad (12)$$

$$Mr=\tfrac{1}{2}\cdot\gamma_b\cdot H_1\cdot L^2 \quad (13)$$

c) if: $H_1<z$:

$$P=\tfrac{1}{2}\cdot\gamma_\omega\cdot H_1^2+\gamma_\omega\cdot H_1\cdot(z-H_1) \quad (14)$$

$$U=\tfrac{1}{2}\cdot\gamma_\omega\cdot z\cdot L \quad (15)$$

$$W=\gamma_b\cdot H_1\cdot L+\gamma_\omega\cdot(z-H_1)\cdot L \quad (16)$$

$$Mm = \frac{1}{2}\gamma\omega \cdot H_1^2 \cdot \left(\frac{H_1}{3} - B\right) + \gamma\omega \cdot H_1 \cdot (z - H_1)\left(\frac{H_1}{2} - B\right) \quad (17)$$

$$MmU=Mm+\tfrac{1}{3}\gamma_\omega\cdot z\cdot L^2 \quad (18)$$

$$Mr=\tfrac{1}{2}\gamma_b\cdot H_1\cdot L^2+\tfrac{1}{2}\gamma_\omega\cdot(z-H_1)\cdot L^2 \quad (19)$$

In the equations hereinabove shown, P,U, W, L, $H_1$, B and z designate the parameters as hereinabove defined. Mm is the driving moment in the absence of uplift pressure U, MmU is the driving moment in the presence of uplift pressure U,$\gamma_\omega$ is the unit weight of water, $\gamma_b$ is the mean unit weight of the water level raising element and Mr is the resisting moment.

Figure 7:
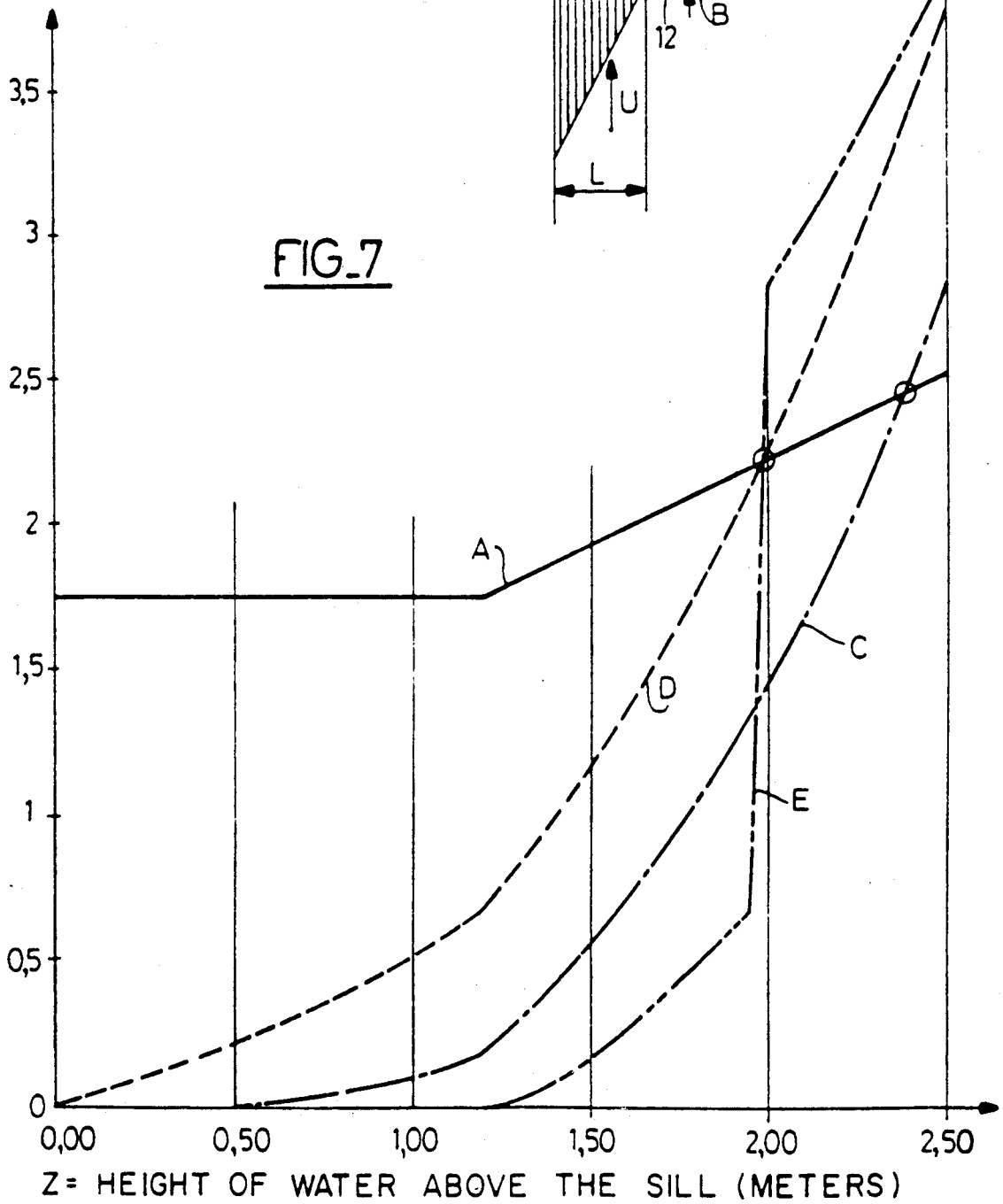
FIG. 7 is a chart showing the driving and resisting forces versus the head of water on the overspill sill and spillway discharge versus the thickness of the overspilling nappe.

On the graph in FIG. 7, curves A, C and D represent the values of Mr, Mm and MmU respectively as a function of the depth of water z above the sill 6 and curve E represents the values of the flow discharged Q as a function of the depth H of the overflowing nappe ($Q=1.8\ H^{3/2}$ with H equal to $z-H_1$ before the element 11 overturns and to z after the said element 11 has overturned). Curves A, C, D and E are plotted from the equations described above for $H_1=1.2$ m, $L=1.1$ m, $B=0.15$ m, $\gamma_\omega=1$ and $\gamma_b=2.4$.

From curves A and C, it can be seen that the driving moment Mm (with no uplift pressure U) reaches the same value as the resisting moment Mr when the value of z is approximately 2.4. In other words, in the absence of uplift pressure U, the water level raising element 11 will overturn when the water level reaches a height 2.4 m above the sill 6. From curves A and D, it can be seen that if uplift pressure U is present, the driving moment MmU reaches the same value as the resisting moment Mr when the value of z is approximately 2 m, which is the maximum level RM in the numerical example considered. In other words, in the presence of uplift pressure U, element 11 will overturn when the water level reaches the maximum level RM. From equations 17 and 19, it can be seen that if it were desired that the element 11 should overturn, in the absence of uplift pressure U and without changing the value of height $H_1$ of the element 11, at a value of z of 2 m, i.e. for the maximum water level RM, it would be necessary to reduce the value of $\gamma_b$ and/or the value of L and/or the value of B from the values taken above.

From this, it can be seen that, by appropriately selecting the size and weight of the water level raising element 11 and the size of abutment 12, it can be so arranged that the element 11 will overturn at a predetermined headwater level. It can also be seen that if the element 11 had been designed to overturn at a predetermined water level in the absence of any uplift pressure acting on its underside, and if the seal between the element 11 and the sill 6 is not fully efficient, an uplift pressure will act on the underside of the element 11 causing it to overturn at a lower water level than the aforementioned predetermined water level. Defective watertightness is thus not dangerous but is more of a safety factor in that it encourages the overturning of the element.

This can be put to effective use to cause the element 11 to overturn even more reliably and more precisely with respect to the predetermined water level. It may be beneficial to arrange for there to be little or no uplift pressure U acting on the element 11 when the headwater level is below a predetermined level and then for a substantially higher uplift pressure to act suddenly on the element 11 precisely when the water level reaches the said predetermined level, with the elements designed so that at this precise instant the driving moment suddenly changes from a slightly lower value Mm than the value of the resisting moment Mr to a substantially higher value MmU than the value of the said resisting moment Mr. For this purpose, it is possible to provide a triggering device such as the example shown in FIG. 9. The triggering device shown in FIG. 9 consists basically of a vent pipe 21 which under normal conditions keeps the area underlying the water level raising element 11 at atmospheric pressure, the top or upper end 21*a* of the vent pipe 21 being at a level N which is the water level at which it is desired for the element 11 to overturn. The pipe 21 may be straight and pass through the element 11 as shown by the solid lines in FIG. 9 or it may be bent as shown by the chain dotted lines marked 21' in FIG. 9 so that its top end lies farther upstream than the element 11, or again the vent pipe may pass through the sill 6 as also shown by the chain dotted lines marked 21'' in FIG. 9. If more than one water level raising element 11 are provided and designed to overturn at different water levels such as N1, N2 and RM (FIG. 3) at least one vent pipe 21 is provided for each element 11 and each pipe rises upwards to a level N equal to level N1 or N2 or RM at which the relevant element is to overturn. In this case, of course, the areas of the sill 6 underlying the water level raising elements designed to overturn at different water levels must be isolated from each other by an appropriate pattern of seals.

Figures 8A, 8B, 8C, 9, 10A, 10B, 10C:
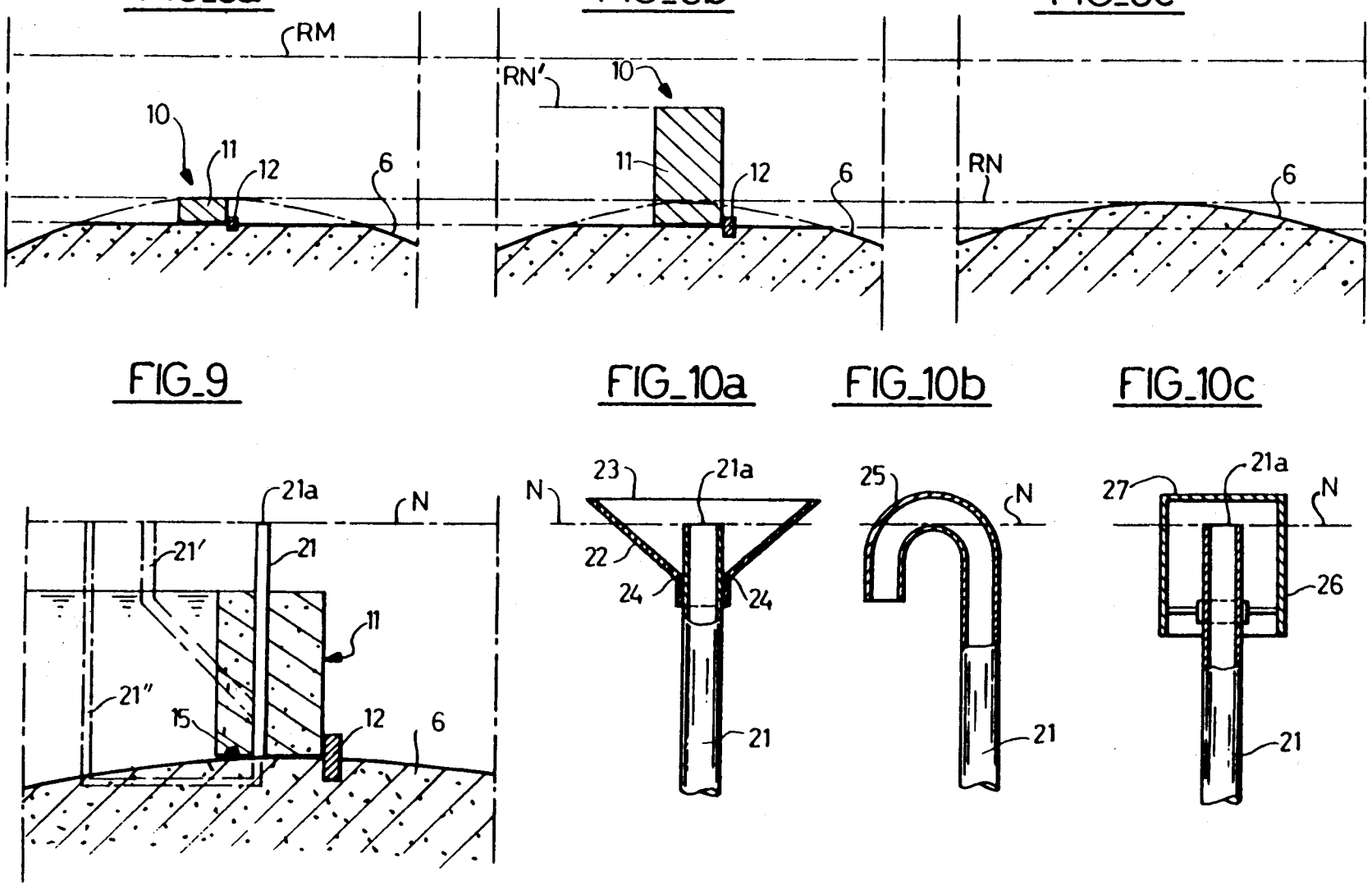
FIGS. 8*a* to 8*c* are cross sections comparing maximum nappe thickness in the case of the present invention for water level raising elements of different heights (FIGS. 8*a* and 8*b*) and for a known uncontrolled overspill (FIG. 8*c*).
FIG. 9 is a cross section showing a water level raising element of the invention incorporating a triggering device to overturn the element.
FIGS. 10*a* to 10*c* are larger scale views of various protective devices which can be provided at the top end of the triggering device shown in FIG. 9.

The top end of each vent pipe 21 may be fitted with a protective device against floating debris to prevent them from becoming blocked by such debris, or a protective device against waves to prevent one or more successive waves from triggering the overturning of the water level raising element 11 at the wrong time. Protective devices are illustrated in FIGS. 10*a* to 10*c*. The protective device shown in FIG. 10*a* consists basically of a funnel 22 whose top edge 23 is higher than the level N and which has at least one small hole 24 at a lower level than level N. In FIG. 10*b*, the protective device consists of the vent pipe 21 itself whose top length is bent to a siphon shape 25. Lastly, the protective device in FIG. 10*c* consists of a hood or bell 26 over the top end 21*a* of the vent pipe 21 and whose top surface 27 is slightly higher than level N.

It may be beneficial for improving safety at an existing dam whose overspill sill 6 had originally been set at a level appropriate for the originally-estimated design flood and determines the full supply level RN (FIG. 8*c*), to lower the sill 6 by a few decimeters below its original level (setting the original RN level) and to set on the lowered sill 6 a water level raising means 10 of the invention, consisting of at least one element 11 whose size and weight have been selected in the manner described hereinabove to overturn by rotation around abutment 12 when the headwater level reaches a predetermined level not higher than the maximum water level RM corresponding to the design flood. Under these circumstances, the probability of breaching of the water level raising means 10 remains unchanged but in the event of arrival of an extraordinary flood, the free discharge section available after complete destruction of the water level raising means 10 is substantially increased with the same headwater level in the reservoir, enabling a much larger flood than the flood for which the dam was originally designed to be discharged without risk. If the height of the water level raising elements 11 is equal to the amount by which the sill 6 is lowered (FIG. 8*a*), the result is simply an increase in the safety of the structure with the same full supply level RN as before the sill 6 was lowered (FIG. 8*c*). However, it is possible both to increase the safety of the structure and raise the full supply level to a higher level RN' by making the height of the water level raising elements such that their crests lie at a higher level than RN but below RM (FIG. 8*b*).

Figure 11A:
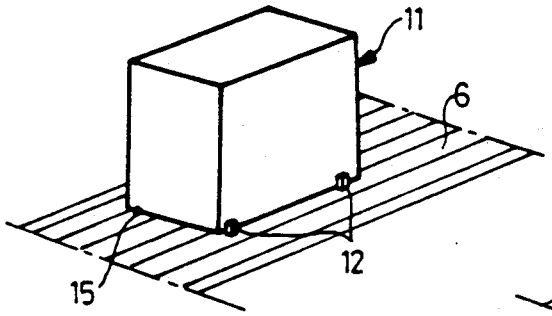
FIGS. 11*a* to 11*g* are perspective views of various possible embodiments of the water level raising elements of the invention.
Figure 11B:
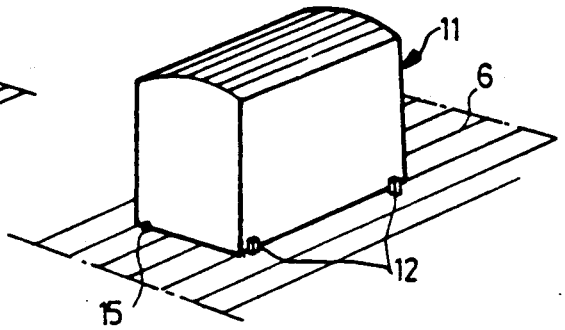
Figure 11C:
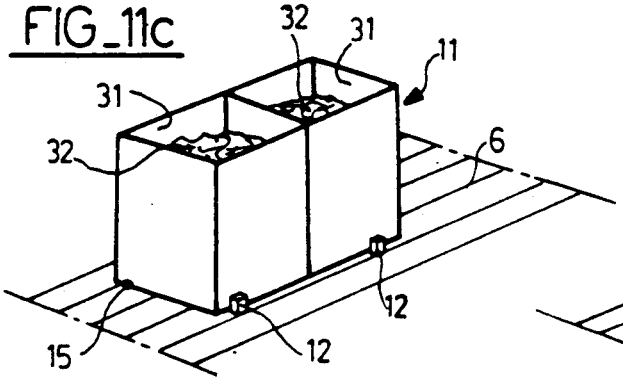

In the foregoing description, it is assumed that each water level raising element 11 consists of a block of substantially parallelepiped shape. The block 11 may be a solid block of plain or reinforced concrete with a flat (FIG. 11*a*) or hogged (FIG. 11*b*) top surface. In another form of construction, each element 11 may consist of a hollow block as shown in FIG. 11*c* having one or more compartments filled with a weighting or ballasting material 32 such as sad, gravel or other weighty bulk material. A cover (not illustrated) may be provided to close the compartment(s) 31 after being filled with the weighting material. The type of construction shown in FIG. 11*c* is particularly suitable when the water level raising means 10 is to comprise several elements 11 all of the same height but overturning at different headwater levels. In this case, the weight of each element 11 can be controlled by filling with an appropriate quantity of weighting material to ensure each element 11 overturns at the predetermined headwater level.

Figure 11D:
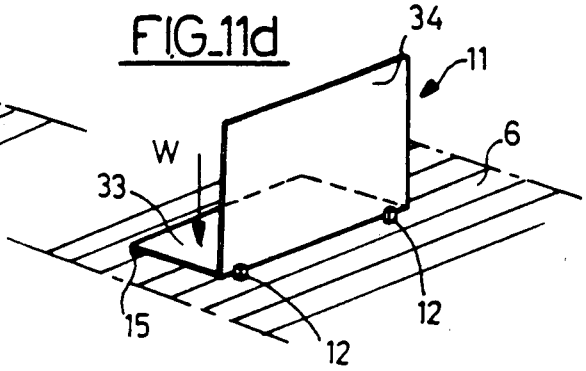

In another embodiment of the invention, each water level raising element 11 may consist of an assembly of plates made of concrete, steel or any other appropriate stiff heavy material. As shown in FIG. 11*d*, the assembly may comprise a horizontal or approximately horizontal rectangular base plate 33 and a vertical or approximately vertical rectangular plate 34 rising from the trailing or downstream edge of the plate 33. It can be seen that in this case, the weight of water overlying the base plate 33 applies a resisting load W and contributes to the stability of the element so long as the headwater level has not reached the predetermined level at which the said element overturns.

Figure 11E:
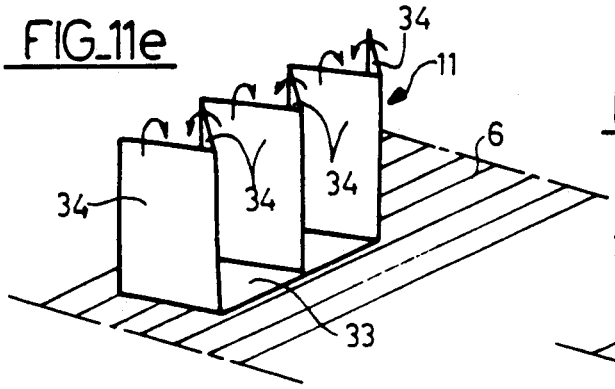
Figure 11F:
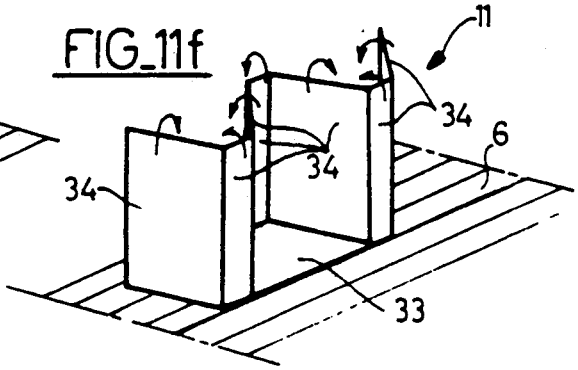
Figure 11G:
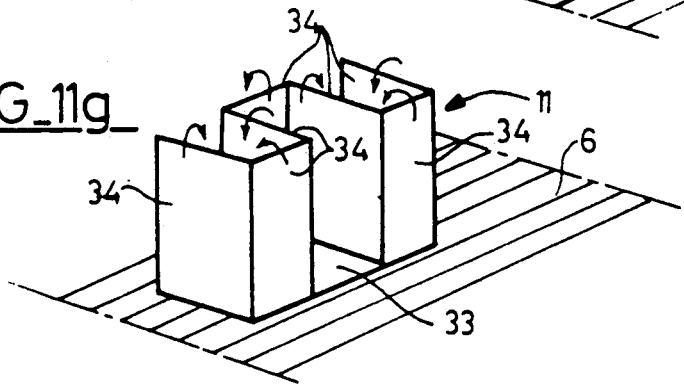

As shown in FIGS. 11*e* to 11*g*, the assembly of plates may comprise several substantially rectangular vertical or approximately vertical plates 34 affixed at their lower edges to the base plate 33 and joined together at their contiguous vertical edges to form what resembles an accordeon screen. All the plates 34 are of the same height but their widths may be identical (FIG. 11*e*) or different (FIGS. 11*f* and 11*g*). In this case, each element has a nonrectilinear crest line, for example a saw-tooth line (FIG. 11*e*) or truncated saw-tooth line (FIG. 11*f*) or a square wave line (FIG. 11*g*). Unlike FIG. 11*d* in which the water level raising element 11 is viewed from the downstream side, in FIGS. 11*e* to 11*g*, the element 11 is viewed from the upstream side. The embodiments illustrated in FIGS. 11*e* to 11*g* are attractive in that they lengthen the developed overspill length which, for a given headwater level, reduces the head of water on the sill for discharging the smaller and thereby the more frequent floods, without destruction of the water level raising means or deleteriously affecting safety, all as explained hereinbefore. Furthermore, it also enables the height of the water level raising elements to be increased accordingly and the headwater level commensurately. For example, a crenellated arrangement as shown in FIG. 11*g* triples the overspill length and thus halves the head on the sill at low discharges, permitting a corresponding increase in reservoir storage capacity without affecting the discharge capability for large floods.

Instead of the plates 34 being flat, they can be given a bowed or corrugated shape to increase the overspill length.

Figure 12:
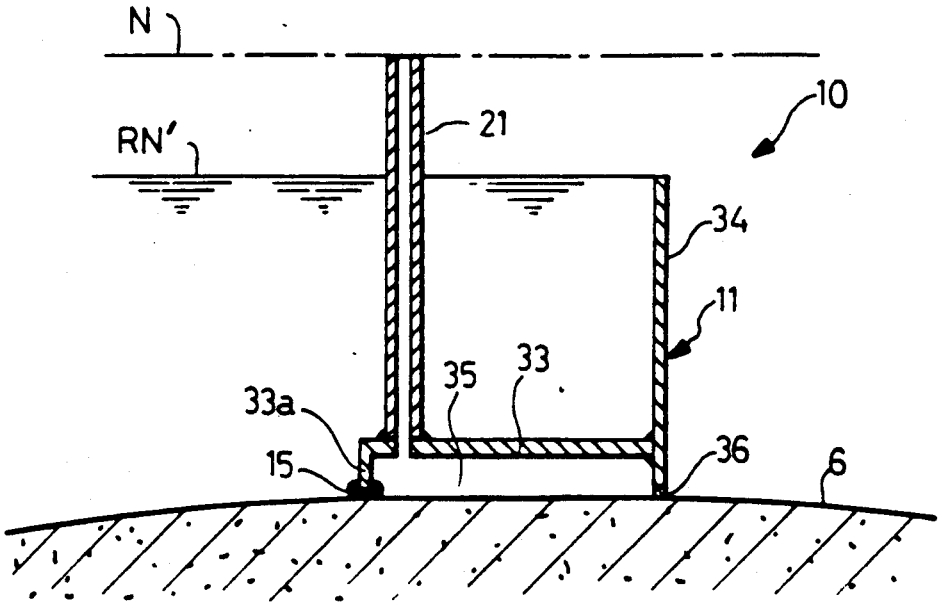
FIGS. 12 to 14 are vertical sections of other possible variants of the water level raising elements of the invention.

FIG. 12 is a vertical cross section through a water level raising element 11 similar to those shown in FIGS. 11*d* to 11*g* with, in addition, a vent pipe 21, provided for the same purpose as in FIG. 9. In FIG. 12, the horizontal plate 33 is fixed to the vertical plate 34 in such a way as to place it some distance above the spillway sill 6 and on its upstream side it has a downturned lip 33*a*. The seal 15 is located between the lip 33*a* and the spillway sill 6. This arrangement forms a chamber 35 under the plate 33 into which the lower end of the vent pipe 21 opens. A hole 36 is provided at the bottom of the plate 34, this hole 36 being smaller in diameter than the bore of the vent pipe 21.

With the water level raising element as shown in FIG. 12, when the headwater level is close to but lower than level N, waves on the water surface might cause water to enter vent pipe 21. This ingress of water would partially fill chamber 35 which would simultaneously empty through the hole 36. This prevents the build up of uplift pressure under the plate 33 due to wave action so long as the headwater level has not reached the level N at which it is desired that the water level raising element 11 should overturn. The chamber 35 and the hole 36 thus increase the accuracy and precision of the overturning setting. It is of course possible to provide a chamber similar to chamber 35 under the element shown in FIG. 9 together with a drain hole to this chamber similar to the hole 36.

Figure 13:
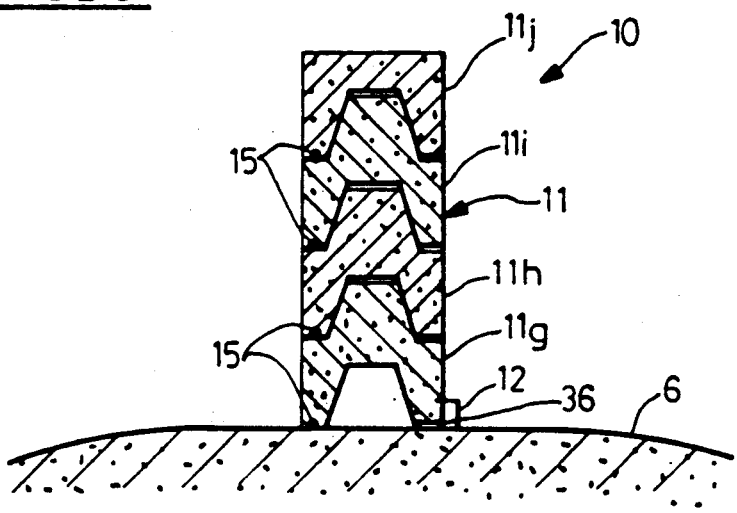

FIG. 13 is a vertical cross section through a water level raising element 11 made up of a stack of modules 11g to 11j. The shape of the modules should preferably be such that they interlock to prevent sliding with respect to each other under the water loads acting on them in service. The modules may all have the same or different vertical dimension(s); for example, the top module 11j has a smaller vertical dimension than the other modules shown. This type of water level raising element construction not only renders the installation of the water level raising means easier and more convenient but it is also possible to alter the height of the said means according to the season of the year, still without requiring any particular human supervision.

Figure 14:
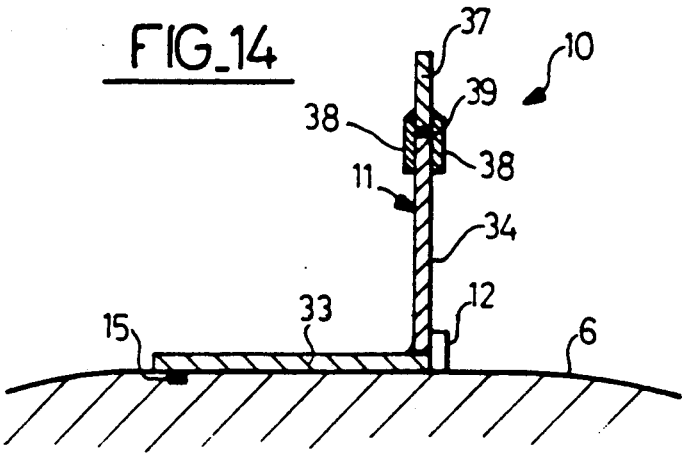
Figure 15:
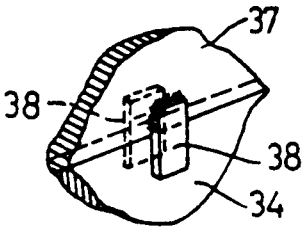
FIG. 15 is a perspective view of a detail of the element shown in FIG. 14.

FIG. 14 illustrates a water level raising element 11 which is modular like the one in FIG. 13 but consisting of an assembly of plates 33, 34 and 37. The plates 33 and 34 are joined rigidly together as an element 11 of FIG. 11d while the plate 37 can be fitted to the plate 34 in a semipermanent fashion as desired, for the purpose of heightening the said plate 34. The plates 34 and 37 can be held together by means of two or more pairs of fishplates 38 (one pair of which is visible in FIGS. 14 and 15) rigidly attached to one of the plates 34 or 37. Instead of these fishplates 38, it is possible to use strips running the whole length or width of plates 34 and 37. A seal 39 is provided between the plates 34 and 37. Of course, multiple vertical plates can be used instead of only the two shown as 34 and 37 in FIG. 14.

Figure 19B:
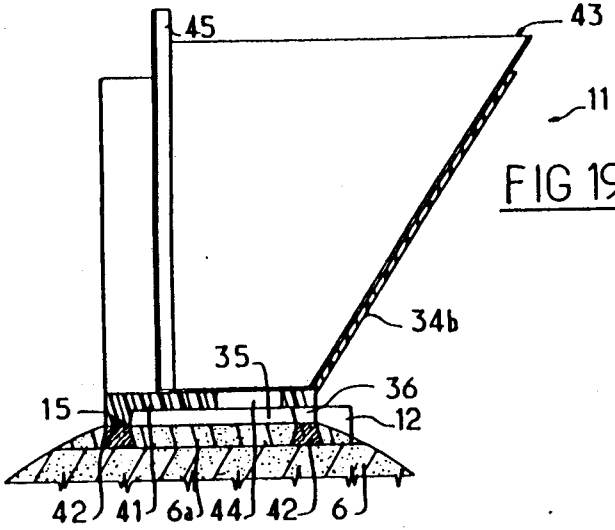
FIGS. 19*a* and 19*b* are two views similar to that in FIG. 19 showing two variants.
Figure 19A:
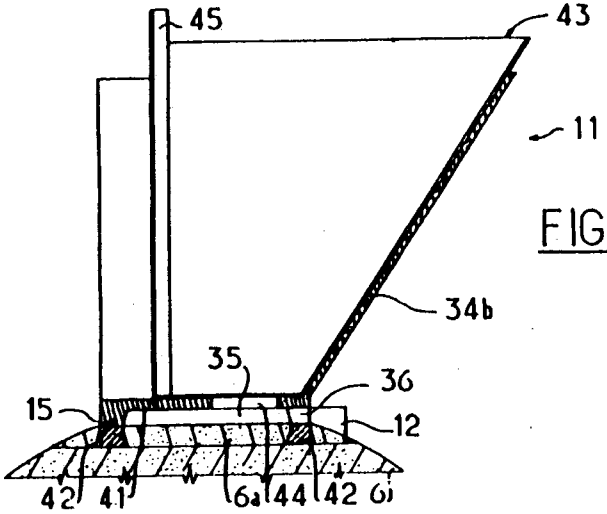
Figure 16:
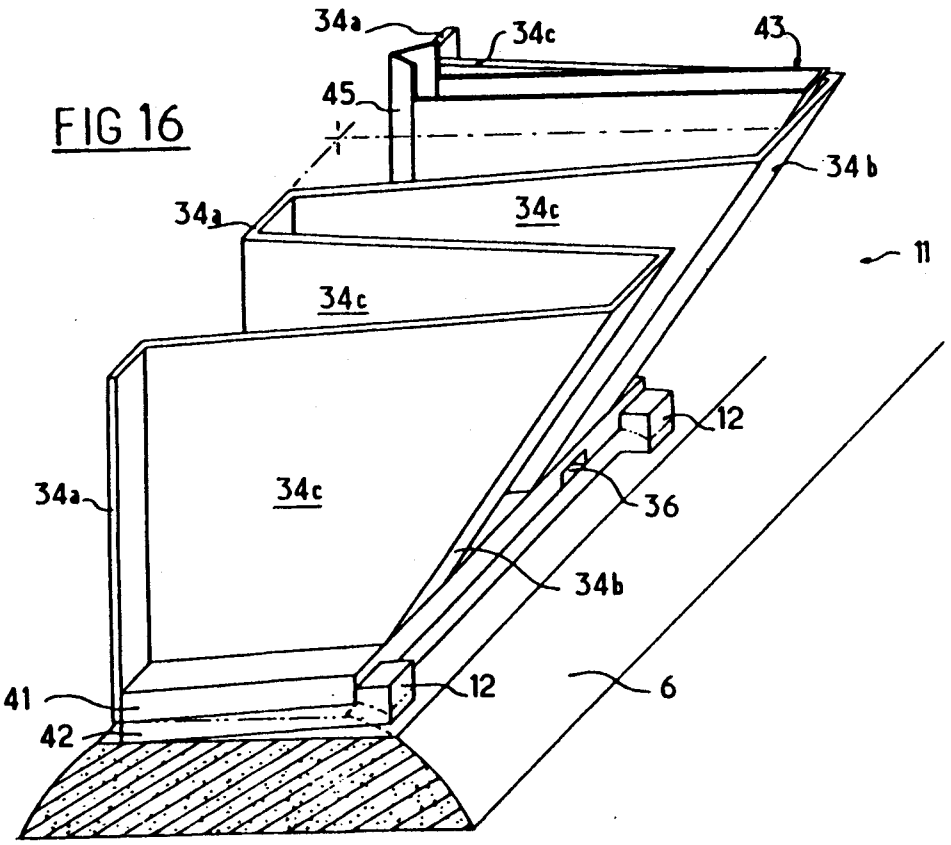
FIG. 16 is a perspective view of another embodiment of the water level raising element of the invention.
Figure 19:
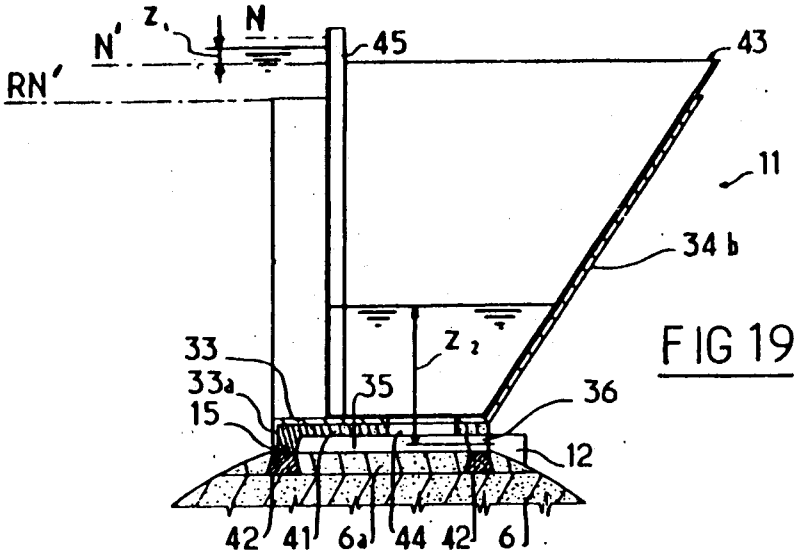
FIG. 19 is a cross section taken along line XIX—XIX in FIG. 18.
Figure 17:
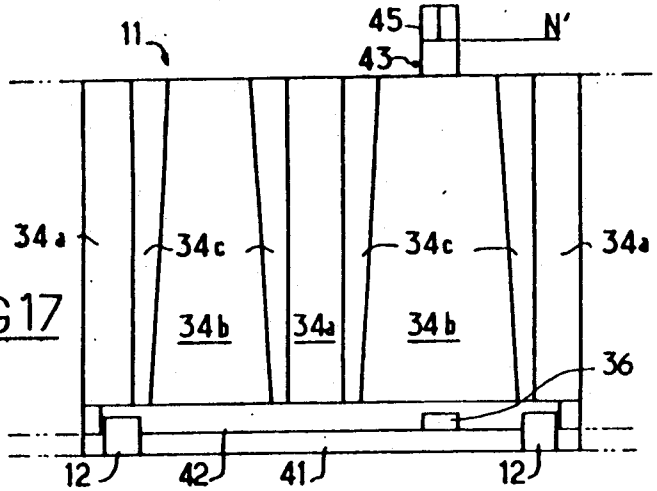
FIG. 17 is a view in downstream elevation of the water level raising element in FIG. 16.

In the embodiment shown in FIGS. 16 to 19, the parts of the water level raising element 11 which are identical to or serve the same purpose as those in the embodiments previously described, in particular those shown in FIGS. 11f and 12, are designated by the same reference numerals. As can be seen in FIGS. 16, 17 and 19, the upstream plates or panels 34a of element 11 are vertical and rectangular in shape while the downstream plates or panels 34b are trapezoidal in shape and are inclined such that their top edges lie farther downstream than their bottom edges. The plates or panels 34c spanning between plates or panels 34a and 34b are vertical and trapezoidal in shape. With such an assembly, when a flood is spilling over the water level raising element, the flow pattern over the water level raising means is improved the overspill length is further increased as compared with the embodiment shown in FIG. 11f. As explained hereinabove, increasing the overspill length reduces the head or depth of water above the water level raising elements for a given discharge rate, and thereby enables the height of the water level raising elements to be increased commensurately.

Figure 18:
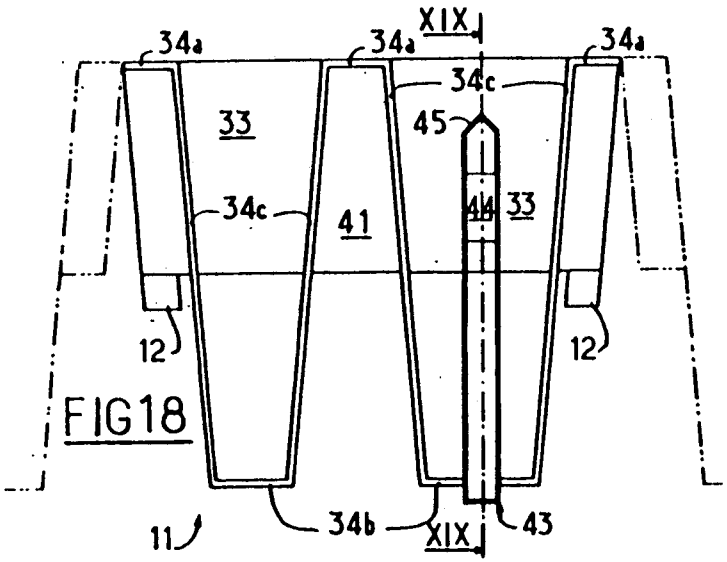
FIG. 18 is a plan view of the water level raising element in FIGS. 16 and 17.

The plates of panels 34a, 34b and 34c and base plate 33 are preferably made of steel but they can also be made of concrete, synthetics or any other appropriate material. As can be seen in FIG. 19, the base plate 33 sits on and is affixed to a pad 41. Pad 41 is preferably made of concrete, e.g. reinforced concrete. As shown in FIG. 18, pad 41 is trapezoidal in shape when seen in plan view with its longer side facing upstream and its opposing parallel side facing downstream. In this manner, when a plurality of water level raising elements 11 are side-by-side, the rotation of the element which overturns first is not hampered by the adjacent elements.

As shown in FIG. 19, pad 41 rests on a frame 42 of the same trapezoidal shape as pad 41. The supporting frame 42 may be made for example from concrete, with or without filler, reinforced concrete, steel, synthetics or any other appropriate material. Two abutments 12 are located near or at the ends of the downstream side of frame 42. These two abutments 12 may be built or fabricated integral with frame 42. As shown in FIG. 19, frame 42 rests on the sill 6, previously lowered in the case of an existing spillway or appropriately designed and built in the case of a new spillway. A layer of cement 6a of appropriate thickness is then poured on sill 6 to encase frame 42 so that its top surface is flush with the final sill level, ready to receive the water level raising element 11.

As can be seen more particularly in FIG. 19, the underside of pad 41 is shaped to form a chamber 35 between the said pad and the surface of sill 6. There is at least one opening 36 on the downstream side of pad 41 which acts as a drain hole allowing any water in chamber 35 to drain out by gravity.

As can be seen in FIG. 18, the crest line of water level raising element 11 has the geometry of two truncated waves forming two troughs with their open ends pointing upstream. An inlet well 43 is assembled on one of the troughs. A hole in the floor of inlet well 43 registering with two other holes in base plate 33 and pad 41 respectively together form a passage 44 connecting inlet well 43 with chamber 35.

As can be seen in FIG. 18, inlet well 43 has a substantially elongated rectangular horizontal cross section in the upstream-downstream direction. This elongated shape offers a long overspill length when the water level reaches the rim of the inlet well. The upstream end of inlet well 43 is extended vertically upwards by a deflector 45 which improves the flow pattern of the overspilling water and diverts any floating matter to prevent its ingress into the inlet well 43.

Inlet well 43 can be made of steel, concrete, synthetics or any other appropriate material and it can be affixed to base plate 33 by welding, glueing, bonding, cementing, bolting or any other method suitable for the materials employed.

As can be seen in FIGS. 17 and 19, the top rim of inlet well 43 lies at a level N, higher than level RN' which is the level of the crest of water level raising element 11 determining the reservoir full supply level or normal water level.

The manner in which water level raising element 11 shown in FIGS. 16 to 19 functions will now be described. When the headwater level reaches level RN' when a river flood arrives, the water begins to spill over the crest of water level raising element 11 but the element remains stables because the moment of the driving forces about abutments 12 is less than the sum of the moments of the dead weight of the element 11 plus the weight of water overlying base plate 33. When the headwater level reaches level N', water begins to spill into inlet well 43 and drains through passage 44 into chamber 35, from where it escapes through drain 36. Under steady-state conditions, the inflow rate into inlet well 43 minus the outflow rate through drain 36 leaves a certain depth $z_2$ of water in inlet well 43. If $z_1$ designates is the head of water or thickness of the nappe spilling over inlet well 43 (FIG. 19) and $L_d$ designates the overspill length of the rim of inlet well 43, the inflow $Q_e$ into the inlet well is:

$$Q_e = 1.8 \cdot z_1^{3/2} \cdot L_d \qquad (20)$$

If s is the cross-sectional area of drain 36, the outflow $Q_s$ through drain 36 is:

$$Q_s = 2.7\, s\, z_1^{\frac{1}{2}} \quad (21)$$

Under steady-state conditions, $Q_e = Q_s$ and the depth of water $z_2$ in inlet well 43 stabilizes. From Eq (20) and (21), $z_2$ can be expressed as a function of $z_1$ as follows:

$$z_2 = 0.44 \frac{L_d^2}{s^2} \cdot z_1^3 \quad (22)$$

Eq. (22) clearly demonstrates how sensitive the system is. Any small change in the head of water $z_1$ spilling into inlet well 43 is amplified and causes a large change in the depth of water $z_2$ in inlet well 43. This depth of water $z_2$ in inlet well 43 exerts an uplift pressure on the roof of chamber 35 and thereby on the underside of pad 41 tending to cause water level raising element 11 to overturn by rotating about abutment 12. The system can be arranged so that, when the headwater reaches a precisely predetermined level N, the water in inlet well 43 quickly rises to a sufficient level to cause the water level raising element to overturn.

In the variant embodiments shown in FIGS. 19*a* and 19*b*, the base plate 33, plates 34*a*, 34*b* and 34*c*, and pad 41 are built together as a single item e.g. concrete (FIG. 19*a*) or synthetics (FIG. 19*b*). The remainder of the water level raising element 11 shown in FIGS. 19*a* and 19*b* remains the same as in FIG. 19.

Figure 20:
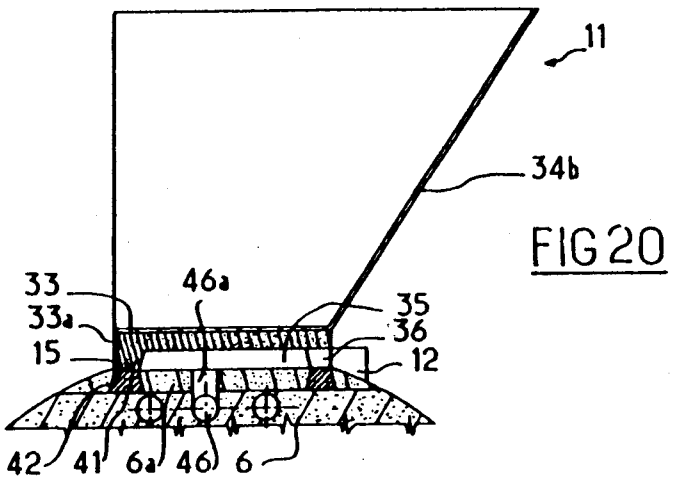
FIG. 20 is a view similar to that in FIG. 19 showing another variant.

FIG. 20 shows a water level raising element 11 similar to the one in FIG. 19 except that it has no inlet well 43. Furthermore, the element 11 in FIG. 20 has no opening in the pad 41 or the base plate 33, i.e. there is no passage 44 as in FIG. 19. In this case, the water is conveyed into chamber 35 through a pipe 46 at one end of which is vertical branch 46*a* opening into chamber 35, the other en being connected to a water inlet located at some point where the water is calm on the upstream side of the dam, and which may be of the type illustrated in FIGS. 10*a* to 10*c* or of the type shown as inlet well 43.

If the water level raising elements 11 are desired to overturn singly or in groups, say two elements at a time, at different but increasingly higher headwater levels, the inlet wells 43 of the various water level raising elements 11 are simply given different heights corresponding to the water level at which it is desired that the relevant elements overturn. In the embodiment shown in FIG. 20, it is also necessary to provide a plurality of pipes 46, as illustrated, i.e. one for each water level raising element 11 or group thereof which is to overturn for a predetermined headwater level.

Figure 21:
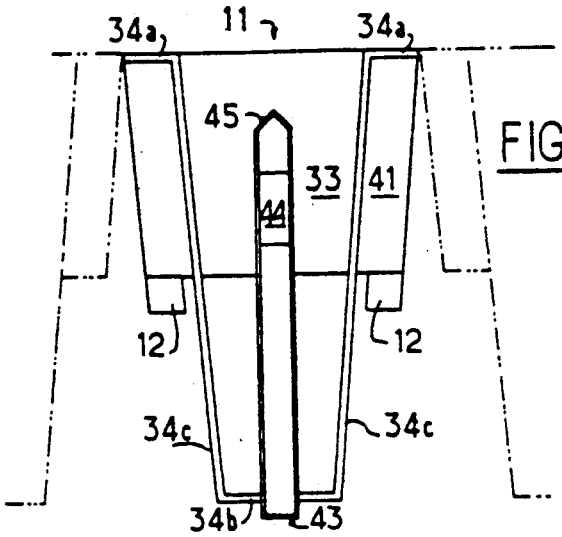
FIGS. 21 and 22 are plan views showing two other variants.
Figure 22:
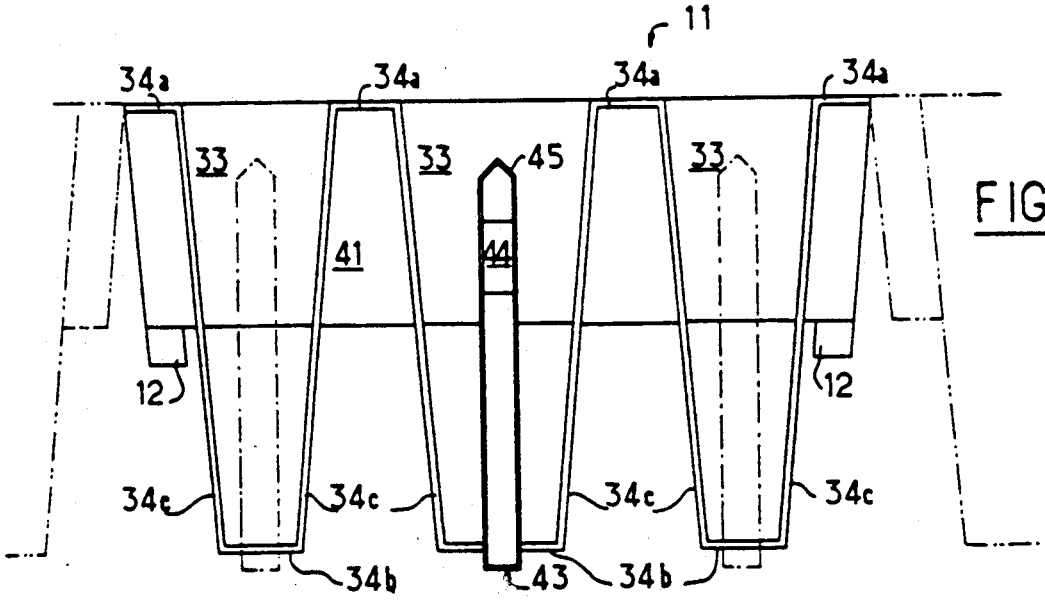

Although the water level raising element 11 shown in FIGS. 16 to 18 have two troughs, it may in fact have more or less, for example one trough as shown in FIG. 21 or three troughs as shown in FIG. 22. Although FIG. 22 shows only one inlet well 43, there may be for example two inlet wells, one in each end trough, as shown by the chain-dotted lines in FIG. 22.

A water level raising means 10 may consist of a plurality of elements 11, all with the same number of troughs or with different numbers of troughs.

In conclusion, the height of the water level raising means 10 and thereby of its elements 11 is a decision based on economics, the desired progression in the overturning of the different water level raising elements, the accuracy and precision of the overturning with respect to the predetermined water level (accuracy and precision can be improved by providing a triggering device conveying water beneath the underside of the water level raising element as described hereinbefore) and the shape of the crest line of the water level raising means, which may be rectilinear, dog legged, zig-zagged, curved or undular. In the numerical example described, the height of the water level raising elements so calculated may range from 0.9 m to 1.5 m by which between 45% and 75% (depending on the final design) of the water which would otherwise, without the water level raising means, be wasted, can be saved.

From the foregoing, it is clear that the water level raising means of the invention provides a substantial and quasi-permanent augmentation of the storage capacity of a dam or other structure with uncontrolled overspill discharge works while at the same time maintaining or improving the safety which is inherent in uncontrolled overspills in that major and extraordinary floods are reliably discharged by the automatic opening (overturning of at least one water level raising element) with no human supervision or action and no control mechanism or device. It is also clear that the water level raising means can be constructed and installed on the spillway sill of a dam or other structure at a much lower cost than the spillway gates hitherto used and without any major modification to the spillway sill.

It is expressly understood that the embodiments of the invention described hereinabove are given on a purely illustrative basis and in no way preclude other alternative forms and that numerous modifications can readily be elaborated by any person ordinarily skilled in the art without departing from the basic principles of the invention. For example, instead of the seal 15 at the base of the water level raising element being positioned near the upstream edge of the said base, it may be located in any other desired position under the base.

What is claimed is:

1. Overflow spillway for dams and similar structures comprising an overspill sill whose crest is set at a first predetermined level, lower than a second predetermined level corresponding to the maximum reservoir level for which the dam is designed, the difference between the said first and second predetermined levels corresponding to a predetermined maximum discharge of a design flood, and a moveable water level raising means on the sill of the spillway, wherein the water level raising means comprises at least one rigid heavy element resting on the crest of the spillway sill and held in place thereon by gravity, the said element having a predetermined height which is less than the difference between the first and second predetermined levels and which corresponds, for a headwater level substantially equal to the said maximum level, to a mean flood with a smaller predetermined discharge than the predetermined maximum discharge, the said element being of such size and weight that the moment of the forces applied by the headwater on the element comes to equal the moment of the gravity forces tending to maintain the element in place on the sill so that consequently the element is destabilized when the water reaches a third predetermined level higher than the top of the element but not higher than the second predetermined level.

2. Overflow spillway as claimed in claim 1, wherein an abutment of predetermined height is provided on the spillway sill at the downstream toe of the water level raising element to prevent the said element from sliding downstreamwards on the said sill.

3. Overflow spillway as claimed in claim 1, wherein, in the case of an existing spillway, the crest of the overspill sill is lowered to a lower level than the said first predetermined level and the water level raising element is installed on the lowered sill and is given a height such that its top is at a level at least equal to the said first predetermined level but lower than the said third predetermined level.

4. Overflow spillway as claimed in claim 1, wherein a seal is provided between the overspill sill and the base portion of the water level raising element near the upstream edge of the said base portion.

5. Overflow spillway as claimed in claim 1, wherein the said water level raising element has the material form of a substantially parallelepipedic solid block.

6. Overflow spillway as claimed in claim 1, wherein the said water level raising element has the material form of a substantially parallelepipedic hollow block containing a weighting material.

7. Overflow spillway as claimed in claim 1, wherein the said water level raising element consists of an assembly of plates which comprises at least one substantially horizontal base plate and at least one substantially vertical and substantially rectangular plate rising from the base plate.

8. Overflow spillway as claimed in claim 7, wherein the vertical plate rises from the downstream edge of the base plate.

9. Overflow spillway as claimed in claim 7 wherein the said plate assembly comprises a plurality of substantially rectangular and substantially vertical plates with their lower edges joined to the base plate and their contiguous vertical edges joined together so as to form a sort of accordeon screen.

10. Overflow spillway as claimed in claim 1, wherein the said water level raising element has a non-rectilinear crest line.

11. Overflow spillway as claimed in claim 1, wherein a plurality of water level raising elements are located side-by-side along the crest of the spillway sill with seals between adjacent side faces of the said elements.

12. Overflow spillway as claimed in claim 11, wherein the size and weight of the water level raising elements are such that at least a first one of said water level raising elements is destabilized when the headwater reaches the said third predetermined level, said third level being lower than said second predetermined level, that at least a second one of said water level raising elements is destabilized when the headwater reaches a fourth predetermined level between the second and third predetermined levels, and that at least a third one of said water level raising elements is destabilized when the headwater reaches a fifth predetermined level higher than the fourth level but not higher than the second predetermined level.

13. Overflow spillway as claimed in claim 1, wherein a hole is provided on the downstream side of said element to drain the underside space between the said water level raising element and the spillway sill.

14. Overflow spillway as claimed in claim 1, wherein it comprises at least one duct means which under normal service conditions maintains the said underside space at atmospheric pressure, said duct means having an upper end which is at a level equal to or substantially equal to the said third predetermined level and vertically above or upstream of water level raising element.

15. Overflow spillway as claimed in claim 14, wherein the underside of said water level raising element is recessed to form a definite chamber, and the lower end of the duct means opens into the said chamber.

16. Overflow spillway as claimed in claim 1, wherein the water level raising element comprises several stacked parts.

* * * * *